US005226714A

United States Patent [19]

Wright

[11] Patent Number: 5,226,714

[45] Date of Patent: Jul. 13, 1993

[54] PIVOTING DRAWER SLIDE SYSTEM

[76] Inventor: Jack V. Wright, P.O. Box 763, Foxworth, Miss. 39483-0763

[21] Appl. No.: 888,875

[22] Filed: May 26, 1992

[51] Int. Cl.[5] ..... A47B 88/00

[52] U.S. Cl. ..... 312/323; 312/331; 312/334.22

[58] Field of Search ..... 312/322, 323, 348.1, 312/331, 334.22

[56] References Cited

U.S. PATENT DOCUMENTS

| | | | |
|---|---|---|---|
| 402,377 | 4/1889 | Wood | 312/322 |
| 4,217,013 | 8/1980 | Herrington | 312/322 |
| 4,258,967 | 3/1981 | Boudreau | 312/322 |
| 4,925,258 | 5/1990 | Ludwig | 312/323 |

*Primary Examiner*—Kenneth J. Dorner
*Assistant Examiner*—Gerald A. Anderson

[57] ABSTRACT

A pivoting drawer slide system for supporting drawer, either in the vertical or horizontal positions. A pair of tracks (22) are mounted in the interior of cabinet. A upper slide (12) is mounted to each side of drawer with a pivoting device mounted near the bottom rear corner of each side of drawer. A pair of lower slides (10) are connected together with a stabilizer bar (16) to form a yoke (32). The yoke (32) rides in the lower slot of track (22). Stop pins (20) and (21) prevent yoke (32) from disengaging track (22). A reversed tee slot (18) is made in each lower slide (10) for the purpose of receiving pivot (14).

1 Claim, 2 Drawing Sheets

PIVOTING DRAWER SLIDE SYSTEM

FIELD OF THE INVENTION

This invention relates to the cabinetry arts, specifically to a drawer supporting slide system which pivots, thus allowing a drawer to change between the vertical and horizontal positions.

BACKGROUND OF THE INVENTION

Throughout history, drawers have been placed in cabinets. To reach the contents on these shelves, individuals must stand on stools, chairs or ladders. This is not only time consuming, but can be very dangerous and sometimes impossible.

The support system disclosed herein permits drawers to be installed at a greater height. The drawer can be pulled out and pivoted downward to a vertical position, thus placing the contents where they are readily seen and reachable. A great benefit for short people, the elderly and the handicapped.

Articles on shelves are stacked on top of each other or one in back of another. This creates a condition where some items must be removed before getting to other items. This can also be a hazardous condition where some items get knocked off the shelves while reaching for others. The pivoting drawer slide system is a positive solution to this condition.

Drawer slides in the past could only be used in situations where a person could see the contents by looking down into the drawer. The pivoting drawer slide system is a positive step toward improving this situation.

Since drawers can be fashioned to any size and for any particular use, this invention allows for better organized cabinet space in a more compact environment. For example, canned goods are now placed on shelves, usually stacked two or three high. With a disclosed drawer constructed, canned goods are placed side by side where they are readily seen and can be removed without problems.

This invention creates a much better organized and safer storage arrangement while eliminating many hazards and wasted space.

Accordingly, besides the objects and advantages of the pivoting slide system stated above, several objects and advantages of the present invention are:

(a) to provide a drawer slide system which has the added advantage of pivoting;

(b) to provide a drawer slide that can be applied at a greater height than is normally used at present;

(c) to provide a drawer slide which will safely support a drawer both in a horizontal and vertical position;

(d) to provide a drawer slide system which allows quick and convenient access to contents of drawer;

(e) to provide a drawer slide that will have the advantage of long life over an extended period.

(f) to provide a drawer slide system that is convenient for the handicapped; and (g) to provide a drawer slide that operates smoothly and safely.

Further objects and advantages are to provide a drawer slide system which can be easily installed, which is simple to use and is inexpensive to manufactures, and furthermore, it would be welcome in the storage field as will become apparent from a consideration of the ensuing description and drawings.

Reference Numerals in the Drawings

| | |
|---|---|
| 10 lower slide | 22 track |
| 12 upper slide | 24 drawer divider |
| 14 pivot | 28 horizontal drawer |
| 16 stabilizer bar | 29 vertical drawer |
| 18 reversed tee slot | 30 cabinet |
| 20 stop pin | 32 yoke |
| 21 stop pin | 34 flange nut |
| 36 shaft | 40 bearing |
| 38 stop washer | 42 container strip |

DETAILED DESCRIPTION

Figure 1:
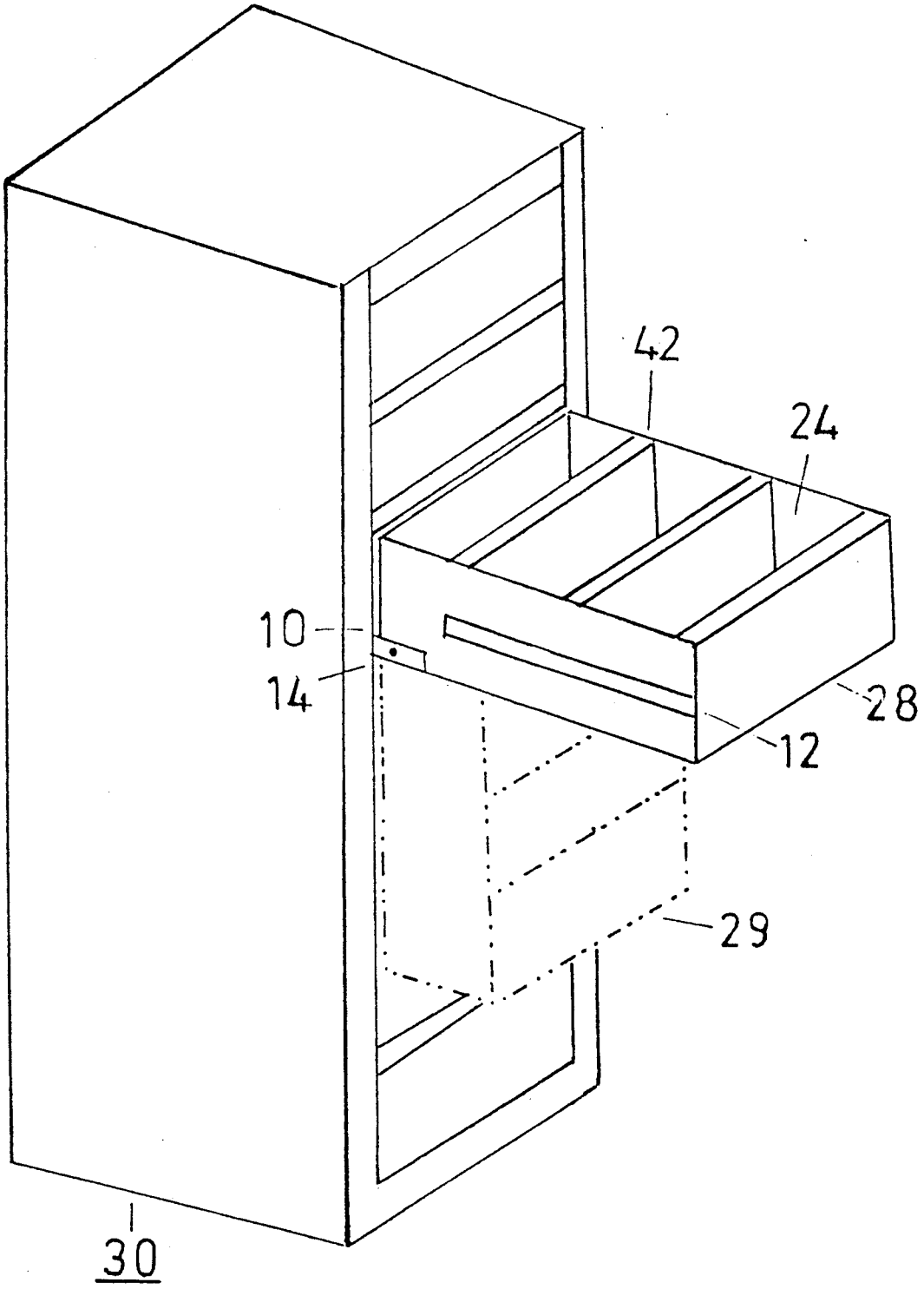
FIG. 1 shows a perspective view of a pivoting drawer slide system, supporting a drawer, both in a vertical and horizontal position, connected to a cabinet.
Figure 2:
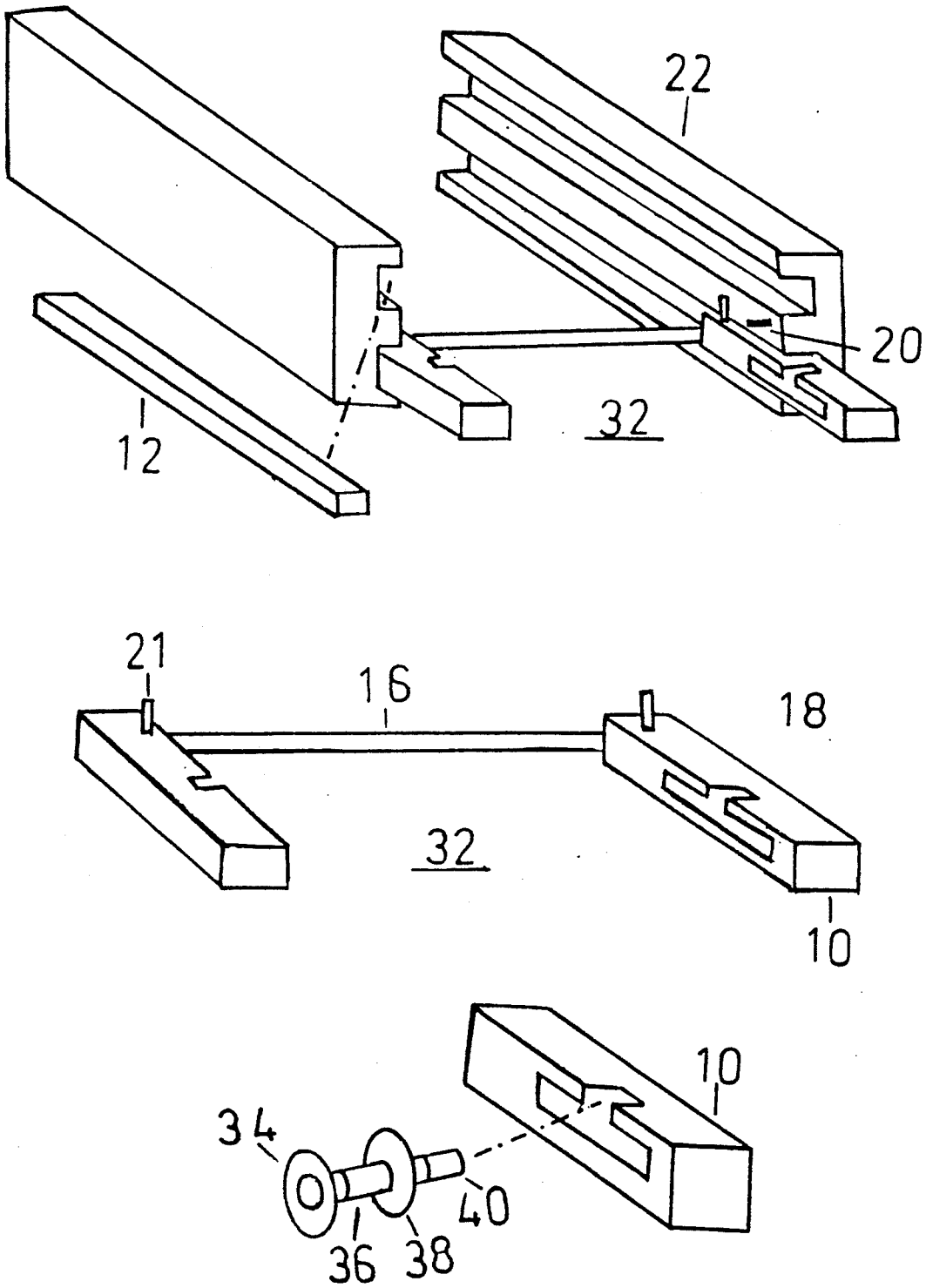
FIG. 2 shows a exploded perspective view of each component part of the pivoting drawer slide system.

A drawer support system as shown on perspective view FIG. 1 and FIG. 2.

A drawer 28 in a horizontal position connected to a cabinet 30 (FIG. 1). Drawer 28 is shown in the previous vertical position (FIG. 1) and designated as 29.

Upper slide 12 is attached to side of drawer 28 (FIG. 1). Lower slide 10 and pivot 14 is shown in their perspective positions (FIG. 1). This allows drawer 28 to pivot from vertical to horizontal positions.

A pair of lower slides 10 are attached to each other by a stabilizer bar 16, thus forming a yoke 32 (FIG. 2).

Track 22 with double slots to receive upper slide 12 and lower slide 10 (FIG. 2). Track 22 is mounted on each side and at the bottom of drawer cavity in cabinet 30 (FIG. 1).

Stop pin 21 is inserted in top of lower slides 10 near the rear and inner edge (FIG. 2).

The yoke 32 formed by lower slides 10 and stabilizer bar 16 is inserted in lower slot of track 22 (FIG. 2).

Lower slide 10 is made slightly larger than depth of slot in track 22 which allows stop pin 21 to move along the center rib of track 22 (FIG. 2).

Upper slide 12 is approximately three quarters the length of drawer 28. This allows drawer to pivot downward at the moment upper slide 12 clears track 22.

Inverted T-shaped slot 18 is located in the side of lower slide 10 (FIG. 2). The slot 18 is approximately three inches long with a vertical slot located in center to create an opening in the top of lower slide 10 (FIG. 2). The purpose of this vertical slot is to allow drawer to be installed in slide system.

Pivot 14 (FIG. 2) is mounted near the lower part of the rear corner on side of drawer 28 (FIG. 1). This becomes the pivot point of drawer from vertical to horizontal position (FIG. 2).

Pivot 14 consists of four parts (FIG. 2). A flange nut 34 is designed to fit flush with the inside of the drawer while a shaft 36 passes through the drawer side and screws into the flange nut 34. A stop washer 38 is attached to shaft 36 to tighten up against the outside of the drawer side, thus securing pivot 14 with the drawer side. A bearing 40 is placed on end of shaft 36. The bearing 40 rides inside of slot 18.

Stop pin 20 is inserted into the center rib of track 22 near the front end. The purpose of stop pin 20 is to keep yoke 32 from leaving track 22 (FIG. 2).

Stabilizer bar 16 is a thin bar that connects the rear end of lower slides 10 (FIG. 2). Bar 16 prevents lower slides 10 from leaving track 22 when drawer is in the vertical position. Bar 16 also keeps the lower slides traveling in unison, which makes the operation of the drawer smoother.

Lower slide 10 is approximately one third as long as drawer 28 and slightly wider than the depth of slot in track 22 (FIG. 2) . The width of lower slide 10 must be enough to install stop pin 21 (FIG. 2).

Divider 24 (FIG. 1) converts drawer 28 into convenient storage bins. Divider 24 supports contents of drawer when drawer is in vertical position.

Container strip 42 is anchored across drawer 28. It is made wider than the edge of divider 24 to form a lip above divider 24. This lip prevents contents of drawer from falling while drawer is pivoting.

FIG. 1 and FIG. 2 illustrate a complete pivoting drawer slide system that is simple yet operates very efficiently. The actual size of the component parts depend on the size of the drawer used.

As illustrated in FIG. 1, this invention consists of a drawer slide system that permits a drawer to be pulled from the cabinet and pivot downward to a vertical position. At all times, the drawer is attached safely to the cabinet through the drawer slide system.

Track 22 is a double slotted track (FIG. 2). Track 22 is designed to permit the travel of lower slide 10 and upper slide 12 during the operation of drawer. Track 22 is mounted on each side of drawer cavity inside of cabinet.

Upper slide 12 travels inside of upper slot in track 22 (FIG. 2). Upper slide 12 is approximately three fourths as long as drawer, which allows the slide to disengage from track before drawer starts pivoting downward. Upper slide 12 is attached to each side of drawer in a position to allow the upper slide 12 to enter the track when drawer is pushed into cabinet (FIG. 1). Upper slide 12 supports and guides drawer while traveling in the horizontal position.

A yoke, generally designated in FIG. 2 as 32, travels in the lower slot of track 22. This yoke 32 consists of a pair of lower slides 10 and a stabilizer bar 16. By connecting the pair of lower slides together with the stabilizer bar, the yoke is permitted to work as a single unit when traveling in the track which in return creates a smooth operation and prevents the lower slides from leaving the track.

The lower slide 10 (FIG. 2) is approximately one third the length of the drawer. This slide is slightly wider than the depth of the slot in track 22 to allow for stop pin 21. Inside lower slide 10 is a reverse tee slot 18 (FIG. 2). The slot 18 in lower slide 10 has three purposes. First, the vertical slot permits the pivot 14 to enter the horizontal portion of the tee slot after the pivot 14 has been installed on drawer. Second, the forward horizontal portion of the tee slot permits the pivot to enter into a pivoting position with that part of the lower slide cantilevered over the edge of the cabinet. The forward portion of the reversed tee slot also permits the pivot to become locked into the lower slide, where it cannot be accidentally disengaged while drawer is being pivoted. Third, the rear portion of the reversed tee slot allows the pivot to travel toward the rear of lower slide 10 to permit drawer to travel against stabilizer bar, when drawer is pushed into cabinet. By allowing drawer to move against stabilizer bar in cabinet, this permits more room for drawer in cavity. Lower slide 10 also becomes a holding means for supporting the drawer when drawer is in the vertical position.

Stop pins 20 and 21 (FIG. 2) are designed to prevent yoke 32 from leaving track 22 after system has been installed in cabinet. Stop pin 21 is inserted into top of lower slide 10 near the inside rear corner leaving approximately three quarters of an inch protruding above slide 10. Stop pin 20 is inserted into the center rib of track 22 (FIG. 2) after yoke 32 has been slid into track 22. Stop pin 20 protrudes approximately one half inch from track 22 in order to connect with stop pin 21, thus stopping the forward travel of the yoke.

The pivot 14 (FIG. 2) is made of four parts. First, a hole is drilled through the side of the drawer near the lower rear corner. A flange nut 34 is placed inside of drawer while a shaft 36 is inserted through hole in drawer and screwed into flange nut. As the shaft is screwed into flange nut, the stop washer 38, which is an integral part of shaft 36, will tighten up against the outside of the drawer. A bearing 40 is inserted on outer end of shaft. Pivot 14 is installed on each side of drawer.

After the tracks have been installed in cabinet and the yoke inserted into the tracks, the drawer is lifted up and the bearing ends of the pivots are inserted into the lower slides by way of the reversed tee slot. The drawer will now slide into the cabinet or pivot into a vertical position in front of cabinet.

The dividers 24 as shown in FIG. 1 will act as platforms for goods placed in drawer when it is in vertical position.

The container strip 42 (FIG. 1) is a strip placed across the drawer to secure goods on dividers while drawer is being pivoted to and from the horizontal position, yet it will allow goods to be placed and removed from drawer.

Accordingly, it is the primary object of this invention to provide a better system for storing and removing items from high storage space than has been previously used. The pivoting drawer slide system has the additional advantages in that it provides a safer means of storage;

it creates a more practical means of storage for the handicapped;

it provides a storage system which is better organized in that each item can be readily seen and safely removed;

it provides a system that can be readily produced from available material and where only simple tooling is required to manufacture; and it provides a simple pivoting device that is strong, safe and reliable.

Some of the drawer slides used today could be converted to pivot downward into a vertical position, however, they would require several changes including deletions, additions and rearrangements of component parts. Nonetheless, in no case in the prior art will these slides work to produce the same pivoting action of this invention without the combination of deletions, additions and rearrangement of component parts.

The objects stated above depend greatly on the action of the yoke and the pivoting device as shown in the drawings.

The lower slide cantilevers over the face of the cabinet to position drawer so it can pivot freely downward. The lower slide supports the drawer during the pivoting operation and in the vertical position.

The pivoting device allows the drawer to pivot in a smooth, workable and safe manner. The pivoting device is a strong, reliable method for supporting the drawer.

The stabilizer bar connects the two lower slides to form a rigid yoke that permits the drawer to travel in a smooth, dependable manner, without wobble or jamming.

The upper slide attached to the drawer is a ridged method for support and guidance of the drawer during travel in horizontal position.

The track mounted to the interior of the cabinet is ridged, unflexing and used to support guides.

Stop pins are provided as a safe method to prevent lower slides from disengaging track. The reversed tee slot in lower slides provides for a quick and easy procedure for mounting and removing drawer from slide system,.

In conjunction with the pivoting drawer slide system, the drawer is divided into small compartments and a container strip has been added to further the safety of the system.

The pivoting drawer slide system has remained obscure throughout the cabinet industry although it is most practical, safe and needed.

Although this invention primarily relates to the cabinetry arts, it could have many other uses in as far as easy accessibility to storage items which are difficult to reach or see. The present invention includes all such equivalent alterations and modifications and the scope of the invention is limited only by the scope of the following claims and their equivalents.

I claim:

1. A drawer support system supporting a drawer with opposite drawer sidewalls and a length in an opening of a cabinet housing having opposed cabinet sidewalls adjacent the drawer sidewalls, said support system providing for sliding the drawer between an open position and a closed position in a horizontal plane and providing for pivoting said drawer downward about an axis in the horizontal plane when the drawer is in the open position, the support system comprising:

a pair of tracks each having a length, a width, parallel twin slots arranged as an upper slot and a lower slot on a side of each of the tracks facing the drawer, said slots running the full length of the track; a first stop pin attached to a center rib of each of the tracks between the twin slots at a forward end of the track; a first slide being received in the upper slot of each of the tracks, one of said upper slides being anchored to each of the opposite drawer sidewalls and being shorter than the length of said drawer so that said slides disengage said tracks when said drawer is in said open position; a second slide being received in the lower slot of each of the tracks and being less than one third the length of the drawer, said lower slide having a second stop pin which engages the first stop pin to prevent the lower slide from leaving the track and said lower slides having a inverted T-shaped slot in a side of each of the lower slides facing said drawer with a open leg of said T-shaped slot extending through a top surface of the lower slides; a pivot pin attached to each sidewall of the drawer near a lower corner and about which the drawer can pivot when the drawer is in the open position, said pins are normally engaged in the T-shaped slots in the closed and open positions of the drawer and can enter or exit the T-shaped slots for quick installation and removal through the open leg of said slot when the drawer is in the open position; and a stabilizer bar extending under the drawer is attached to each of the lower slides to prevent binding of the lower slides in the lower tracks.

* * * * *